US007544870B2

(12) United States Patent
White

(10) Patent No.: US 7,544,870 B2
(45) Date of Patent: Jun. 9, 2009

(54) MUSIC BOX MOVEMENT AND METHOD OF OPERATION THEREOF

(76) Inventor: Richard H. White, 109 Sweetwater Ct., La Grange, GA (US) 30240

( * ) Notice: Subject to any disclaimer, the term of this patent is extended or adjusted under 35 U.S.C. 154(b) by 0 days.

(21) Appl. No.: 11/702,326

(22) Filed: Feb. 5, 2007

(65) Prior Publication Data

US 2008/0184863 A1 Aug. 7, 2008

(51) Int. Cl.
*G10F 1/12* (2006.01)

(52) U.S. Cl. ..... 84/94.1; 84/94.2; 84/95.1; 84/96; 84/97; 84/98

(58) Field of Classification Search ..... 84/98, 84/94.1, 95.1, 97, 94.2, 96
See application file for complete search history.

(56) References Cited

U.S. PATENT DOCUMENTS

| | | | | | |
|---|---|---|---|---|---|
| 527,811 | A | | 10/1894 | Richter | |
| 560,936 | A | | 5/1896 | Rodeck | |
| 593,762 | A | * | 11/1897 | Brachhausen | 84/98 |
| 599,710 | A | * | 3/1898 | Keller | 84/98 |
| 3,559,525 | A | * | 2/1971 | Fishbein | 84/98 |
| 4,466,328 | A | * | 8/1984 | Kitamura | 84/98 |
| 5,698,801 | A | | 12/1997 | Meng-Suen | |
| 5,955,687 | A | * | 9/1999 | Miyagi et al. | 84/97 |
| 5,962,796 | A | | 10/1999 | Nakamura et al. | |
| 5,973,240 | A | * | 10/1999 | Isaka | 84/97 |
| 6,291,749 | B1 | | 9/2001 | Tseng | |
| 6,723,911 | B2 | * | 4/2004 | Muramatsu et al. | 84/723 |
| 6,936,757 | B2 | * | 8/2005 | Muramatsu et al. | 84/94.1 |
| 6,960,710 | B2 | | 11/2005 | Segan et al. | |
| 7,012,178 | B2 | * | 3/2006 | Muramatsu | 84/97 |
| 7,034,215 | B2 | * | 4/2006 | Kaneko et al. | 84/98 |
| 7,321,090 | B2 | * | 1/2008 | Meng-Suen | 84/94.1 |
| 2003/0150316 | A1 | | 8/2003 | Muramatsu | |
| 2004/0123718 | A1 | | 7/2004 | Muramatsu et al. | |
| 2004/0231486 | A1 | * | 11/2004 | Segan et al. | 84/94.1 |
| 2006/0169122 | A1 | * | 8/2006 | Meng-Suen | 84/94.1 |
| 2008/0184863 | A1 | * | 8/2008 | White | 84/95.1 |

* cited by examiner

*Primary Examiner*—Jeffrey Donels
*Assistant Examiner*—Robert W Horn
(74) *Attorney, Agent, or Firm*—Williamson Intellectual Property Law, LLC; Thomas R. Williamson, III

(57) ABSTRACT

A music box movement having a mechanism to impede or cause rotation of star wheels, wherein spaced points on the star wheels pluck the tines of the musical comb to perform a desired series of musical tones. In its preferred embodiment, the mechanism comprises activating arms with rods having tips thereon, wherein the tips contact the surface of the star wheel and only permit rotation of the star wheel when the tips are withdrawn via activation of a computer-controlled solenoid. Alternatively, again via a computer-controlled solenoid, the mechanism actively causes movement of the star wheel by pushing against, or pulling via hooks, the star wheel points to cause rotation. In lieu of a solenoid, computer-controlled electromagnetically-engaged plates in communication with the activating arms are selectively utilized to adhere to a rotating drum, thereby moving the activating mechanism.

18 Claims, 7 Drawing Sheets

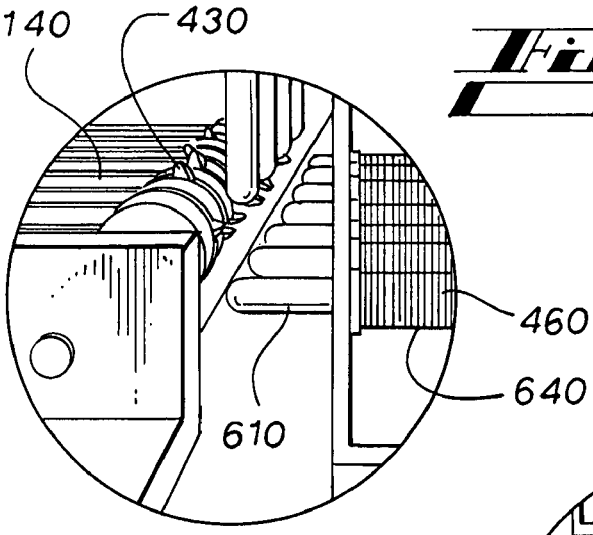
Fig_2C
Fig_2D
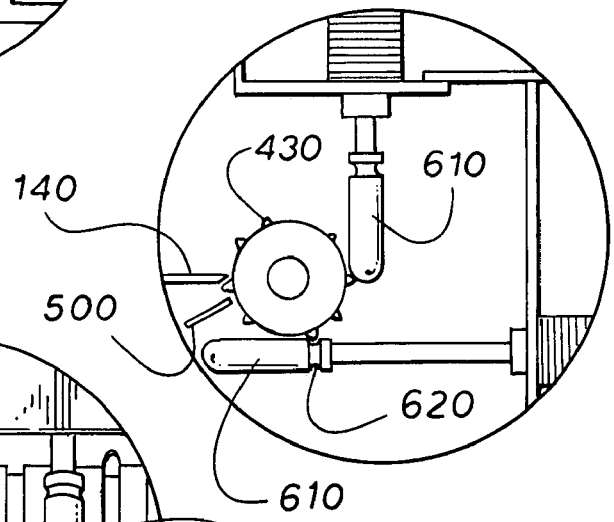
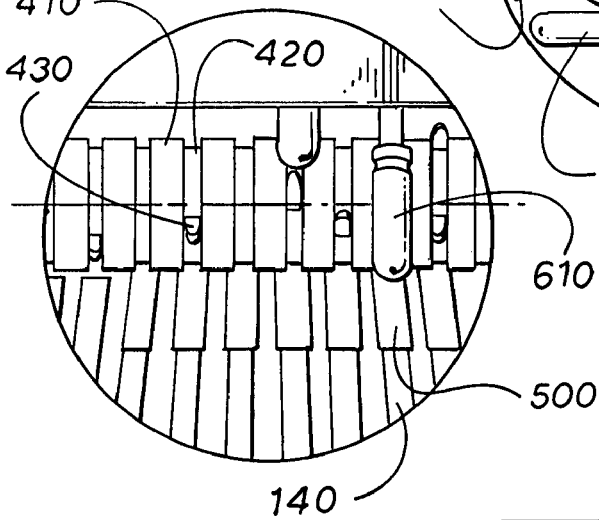
Fig_2E
Fig_2F
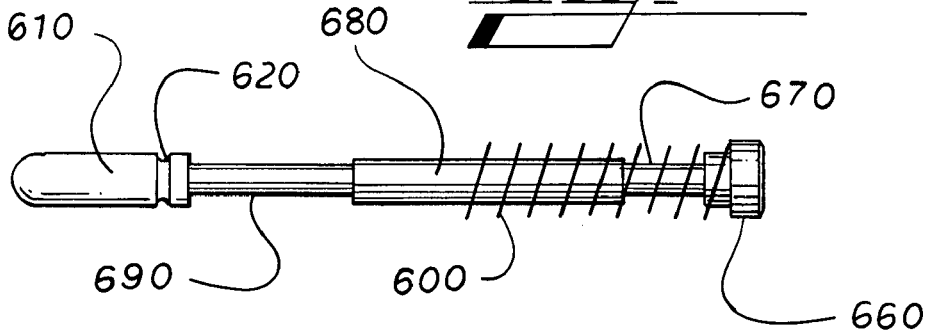

MUSIC BOX MOVEMENT AND METHOD OF OPERATION THEREOF

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The present invention relates generally to music box movements, and more specifically to music box movements operated under computer control via a solenoid or other electromagnetic activating mechanism.

2. Description of Related Art

Many previous music box movements have drive mechanisms and/or tine plucking mechanisms operated via clockwork or other purely mechanical means, whereby a melody provided as part of the music box movement is played. Improvements on such music box movements have relied on electrical motor drive mechanisms to rotate a perforated disc or to pull a perforated tape, wherein the perforations of the disk or the tape engage the points of a star wheel causing rotation thereof, and wherein the star wheel points pluck the tines of the musical comb to play a musical composition according to the pattern of perforations in the disk or tape. Alternately, a drum or disc having protrusions thereon may be rotated to directly pluck the tines or star wheel of a musical comb in a selected pattern and at selected intervals.

However, such previous discs, tapes and/or drums are limited to a fixed single, or fixed multiple, musical composition. Thus, changing the musical composition(s) requires changing a disk, tape or drum, and accordingly, subjects same to the possibility of damage during handling.

Other previous devices have overcome the limited composition problem by incorporating a mechanism to pluck or impact on the tines of the musical comb under computer control via solenoids. Unfortunately, due to the size of the solenoids necessary, the solenoids are staggered or operate through a linkage arrangement. One such a previous device has utilized a complicated pivoting lever mechanism operated via a computer-controlled solenoid to cause rotation of a star wheel having points thereon, wherein the points consequently pluck the musical comb tines. Unfortunately, such complicated pivoting mechanisms have attendant noisy operation and/or a tendency to jam that affects the quality of the musical sound emanating from the music box movement.

Therefore, it is readily apparent that there is a need for a music box movement that permits quiet operation, wherein musical compositions are selected and controlled via a computer operating through an efficient and tightly-spaced electromagnetic mechanism.

BRIEF SUMMARY OF THE INVENTION

Briefly described, in a preferred embodiment, the present invention overcomes the above-mentioned disadvantages and meets the recognized need for such a device by providing a music box movement operated under computer-controlled electromagnetic action, wherein a star wheel is impeded from rotation or is caused to rotate. A plurality of star wheels are disposed upon a shaft separated by spacers, thereby permitting the star wheels to independently freely rotate. A driven roller, either solid or ribbed, is disposed in contact with a portion of the periphery of the plurality of star wheels. As the roller rotates, unimpeded star wheels rotate with it. Star wheels that are impeded do not rotate. Additionally, as the roller rotates, an optoelectronic chopper times the release of the solenoids to permit or cause rotation of selected star wheels, typically via sending a signal back to the computer.

The star wheels have projecting points disposed symmetrically around their surface. Individual solenoid rods comprising tip ends fall under gravitational influence to a position proximate the periphery of the individual star wheels. The star wheels are subsequently impeded in their rotation via the solenoid rods, once one of the star wheel points is blocked by the tip of the solenoid rod.

When it is desired that a selected star wheel rotate, the solenoid is activated by passage of electric current through the coil thereof under computer control, the solenoid rod is withdrawn away from the surface of the star wheel and the blocked star wheel point, and the star wheel rotates. Another star wheel point on the surface of the star wheel rotates through its adjacent tine, causing sound to emanate therefrom.

Because the solenoid rod need only prevent the rotation of the star wheel, it requires a very light electromagnetic field, and thus, a small coil, and the solenoids are able to be positioned in close proximity to one another corresponding to the same spacing as the star wheels. Further, because the solenoid is withdrawn when energized, rather than being forcibly driven down against the surface of the star wheel, its operational sound is greatly reduced.

In an alternative embodiment, the solenoid rod is spring-loaded and selectively driven into, or withdrawn away from, its position against the star wheel periphery. Further, the solenoids are selectively positioned radially about the star wheel periphery, thereby providing increased space for larger solenoids, should such be desired.

In a further alternative embodiment, the solenoid rod passes and tangentially contacts the star wheel periphery, wherein as the solenoid rod passes, it pushes on a star point, thereby causing the star wheel to rotate. Additionally, the solenoid rod selectively comprises a tip and a groove therein, wherein as the tip of the solenoid rod passes the star wheel, the groove engages and captures a star wheel point, thereby causing the star wheel to rotate.

In another alternative embodiment, the solenoid rod selectively comprises a hook end, wherein the hook end is moved past the star wheel and engages a star wheel point. Subsequently, upon retraction of the solenoid, the hook end pulls upon the star wheel point causing rotation of the star wheel.

In the above embodiments, the electromagnetic mechanism selectively comprises a traditional solenoid having a ferromagnetic rod within an insulating tube wrapped with a coil that is electrically energized, or a plate having a coil wrapped therearound, wherein passage of electric current through the coil causes attraction of the plate to the ferromagnetic surface of a rotating drum, thereby clamping the plate to the drum surface. The rotation of the drum thus pulls the plate until the magnetic field is either overcome or relaxed. Because of the thinness of the plate, a plurality of plates can be disposed adjacently in a small space.

According to its major aspects and broadly stated, the present invention in its preferred form is a music box movement comprising a mechanism controlled by a computer operating through electromagnetic energy to selectively play the notes of the musical composition. Rotatable star wheels, either driven by a roller or absent a roller, are operated on via a solenoid or other electromagnetic component that either permits or prevents rotation of the star wheels.

More specifically, the present invention is a music box movement having a base, a musical comb, a motor, a roller assembly and solenoids. The base may be mounted to any suitable substrate via fasteners. The musical comb has an opening in the base below it. The musical comb has tines that vary in length to provide individually different musical tones when plucked.

The roller assembly may selectively be pivotable about a hinge and is secured in place via a catch with a release lever, wherein the catch latches the roller assembly to a post disposed on a mounting plate that separates the musical comb from the base.

The roller assembly comprises a ribbed or smooth roller, optionally the hinge, a circuit board, and gearing to drive the ribbed or smooth roller and also a shaft having spacers and star wheels thereon, wherein the star wheels have star wheel points disposed symmetrically about the periphery of the star wheel.

The star wheels are separated from one another via the spacers and freely rotate about the shaft, unless their rotation is impeded via tips extending from solenoids. The spacers provide separation between the star wheels to permit contact of the tips with the star wheel points. Additionally, the spacers are affixed to the shaft and are in frictional contact with the star wheels, thereby imparting sliding rotational movement to the star wheels as the shaft rotates.

The roller has longitudinal ribs thereon and a toothed chopper wheel at one end thereof. The longitudinal ribs engage the star wheel points when the star wheels rotate and a star wheel point comes into position to be captured by grooves between the ribs. The toothed wheel rotates with the roller and has its teeth separated by openings, wherein the teeth rotate through a gap in an optocoupler to form a light chopper from which a signal can be obtained for timing of further solenoid release.

The circuit board is connected to the motor via wires, and has thereon the circuitry necessary for the operation of the light chopper, as such is known in the art, wherein signals from the light chopper are sent to a computer for timing of solenoid release.

A solenoid frame holds an array of solenoids. The solenoids comprise sleeves with ferromagnetic rods disposed therewithin and an electrical coil wound around the outside of the sleeve. The tips of the rods are non-ferromagnetic material, and may be comprised of brass, rubber, or similar materials having softness to prevent noise and/or damage to the star wheel mechanism. The solenoids are operated via power controlled by signals from a computer or similar controller.

The solenoid frame is angled at forty-five degrees to permit installation of the music box movement in either a horizontal or vertical orientation, such that the solenoid rods, when released from activation will fall under gravitational attraction toward the star wheels, thereby engaging the points thereof.

The solenoid tips are selectively withdrawn to permit their corresponding star wheels to rotate. As a selected star wheels rotates, one of its star points will enter the groove between ribs of the roller, wherein the star wheel will be positively rotated by the roller such that another star point on its periphery passes and plucks its respective tine, thereby preferably causing the tine to emit its characteristic musical tone. Once power to solenoid is removed, the tip falls toward the star wheel and blocks rotation thereof, interfering with passage of a star point rotating into contact with the tip.

As noted above, while the star wheel rotates with its star points engaged between the ribs on the surface of the roller, rotation of roller also causes rotation of the toothed chopper wheel operating the optoelectronic light chopper, wherein light from a light source on the optocoupler is blocked when a tooth rotates in front of it, preventing light from reaching the light receptor. Once the tooth passes, an opening between adjacent teeth permits passage of light from source to receptor and a signal is subsequently sent by the optoelectronic coupler to a computer.

By utilizing the solenoid operated tip/rod combinations without a linkage, operational noise is reduced and/or eliminated. Further, due to a reduced size to merely block rotation of a star wheel, as opposed to forcibly causing the star wheel to rotate, the solenoid size is greatly reduced, thereby permitting adjacent spacing of solenoids that is equivalent to the typical spacing between star wheels of a small profile music box movement.

In an alternate embodiment, the present invention may include solenoids that exert a driving force to a star wheel via contact with a tip end of the solenoid with a star wheel point, wherein the tip end pushes on a star wheel point to initiate rotation. In this embodiment, the solenoid tip ends include a groove therein that captures a star wheel point as the tip passes the periphery of the star wheel to continue to carry the star wheel point, thereby affirmatively rotating the star wheel through a larger distance than would be possible without the groove engaging and carrying the second star wheel point. Another star wheel point on the periphery of the star wheel plucks its respective tine, emitting the selected tone. Once the second star wheel point has rotated out of the groove, the tip can be withdrawn without impediment, wherein shaft rotation causes continued forward rotation of the star wheel.

In yet another embodiment, the tips of the solenoid rods may be replaced with hook ends that are maneuvered past the star wheel points, where subsequently the hook ends selectively engage the points and pull them to cause rotation of the star wheel. This embodiment may also be incorporated into a retrofittable unit that can be disposed over an existing music box mechanism having star wheels to provide an alternative to the drive mechanism thereof.

Still another alternate embodiment comprises an electromagnetic plate and rotating drum combination to replace the solenoids. The plates are wound with a coil that when briefly energized adheres the plate to the rotating drum, causing the plate to be pulled laterally for a short distance until released. A rod or wire is attached to the plate and is thus pulled. The rod may have a hook end and be utilized to pull a star wheel, or alternately, may have a tip end that in a relaxed mode prevents rotation of a star wheel as for the preferred embodiment, but which releases the star wheel when the plate is energized.

Accordingly, a feature and advantage of the present invention is its ability to overcome tendencies of music box mechanisms to jam.

Another feature and advantage of the present invention is its nearly silent operation.

Still another feature and advantage of the present invention is its ability to permit computer selection of music to be played by the music box movement.

Yet another feature and advantage of the present invention is its ability to permit computer control of the tempo of the musical selection.

Still a further feature and advantage of the present invention is its ability to provide a feedback signal for solenoid timing.

Yet still another feature and advantage of the present invention is its ability to permit computer control of individual notes played by a music box movement.

A further feature and advantage of the present invention is its small space requirement.

These and other features and advantages of the present invention will become more apparent to one skilled in the art from the following description and claims when read in light of the accompanying drawings.

BRIEF DESCRIPTION OF THE SEVERAL VIEWS OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which:

FIG. 2C is a side perspective view of solenoid rods shown engaging star wheel points according to the alternate embodiment of the present invention shown in FIG. 2A;

FIG. 2D is a side view of solenoid rods shown engaging star wheel points according to the alternate embodiment of the present invention shown in FIG. 2A;

FIG. 2E is an underneath view of tines engaged by star wheel points according to the alternate embodiment of the present invention shown in FIG. 2A;

FIG. 2F is a side view of a solenoid rod according to an alternate embodiment of the present invention;

Figure 1A:
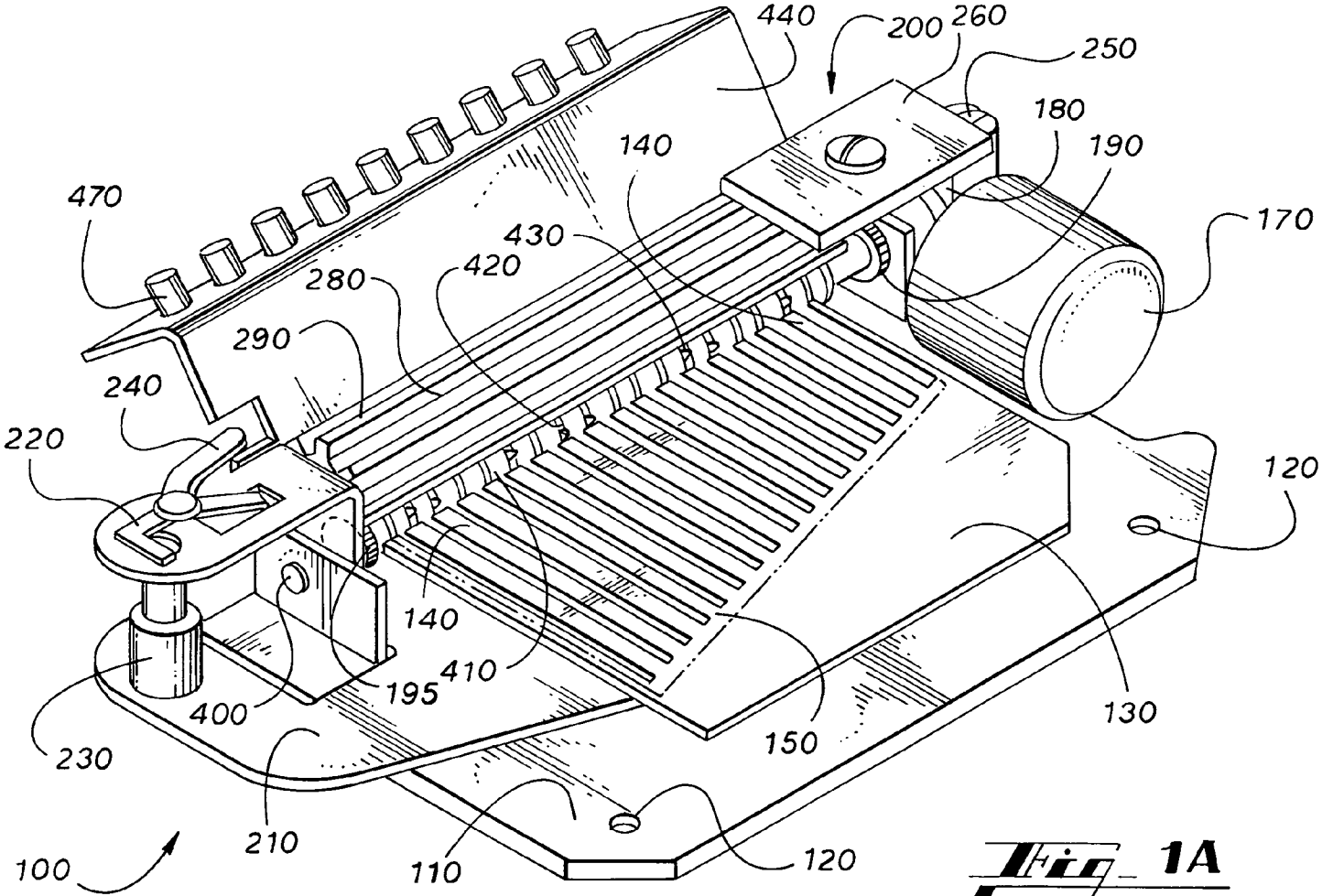
FIG. 1A is a perspective view of a music box mechanism according to a preferred embodiment of the present invention.

DETAILED DESCRIPTION OF THE PREFERRED AND SELECTED ALTERNATE EMBODIMENTS OF THE INVENTION

In describing the preferred and selected alternate embodiments of the present invention, as illustrated in FIGS. 1A-4B, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1A-1D, the present invention in a preferred embodiment is music box movement 100 comprising base 110, comb 130, motor 170, roller assembly 200, mount plate 210, angular drive 180 and solenoid frame 440. Base 110 preferably comprises mounting throughholes 120 and aperture 150, wherein base 110 can preferably be removably affixed to any suitable substrate utilizing any selected fastener, such as to mount base 110 within a decorative music box. Comb 130 is preferably disposed over aperture 150 and comprises tines 140, wherein tines 140 preferably vary in length according to the musical tone desired when they are plucked.

Mount plate 210 is preferably disposed between comb 130 and base 110, wherein mount plate 210 preferably serves to provide spacing between base 110 and comb 130. Post 230 is preferably disposed in a vertical orientation on mount plate 210. Roller assembly 200 preferably comprises catch 220, release lever 240, roller 280, hinge 250, circuit board 260, gearing 190, shaft 400, spacers 410 and star wheels 420, wherein star wheels 420 preferably comprise star wheel points 430, and wherein star wheels 420 are preferably disposed on shaft 400. It will be recognized by those skilled in the art that star wheel points 430 are shown in representative form and that star wheel points 430 could comprise alternate shapes, such as, without limitation, shark's fin shape.

Catch 220 of roller assembly 200 preferably latches roller 280 to post 230. Release lever 240 preferably opens catch 220 to release roller 280 from post 230, thereby preferably permitting roller 280 to be opened one hundred and eighty degrees about hinge 250 to provide access to star wheels 420. Roller 280 is preferably disposed on roller support shaft 340 (best shown in FIG. 1C), wherein roller 280 is preferably fixedly attached to roller support shaft 340. Shaft 400 and roller 280 are in communication via gears 195, wherein rotation of shaft 400 rotates gears 195, and wherein roller 280 rotates on roller support shaft 340.

Shaft 400 preferably has star wheels 420 disposed thereon and separated via spacers 410. Spacers 410 are preferably secured to shaft 400, while star wheels 420 preferably freely rotate about shaft 400 but are lightly frictionally engaged by spacers 410 and/or shaft 400, unless their rotation is impeded via tips 490 of solenoid 460 as more fully described herein below. Thus, when impeded, star wheels 420 slip on rotating shaft 400, but when not impeded, rotate with shaft 400 due to the light frictional engagement of spacers 410 and/or shaft 400. Spacers 410 are preferably selected to provide adequate separation between star wheels 420 to permit contact of tips 490 with star wheel points 430, as more fully described hereinbelow.

Roller 280 preferably comprises longitudinal ribs 290 separated by grooves 295, and toothed wheel 300, wherein longitudinal ribs 290 are preferably engaged by star wheel points 430 entering grooves 295 and being tentatively retained therein, thereby causing rotation of star wheels 420 when roller 280 rotates. Toothed wheel 300 (best shown in FIGS. 1C and 1D) is preferably integrally formed as part of roller 280 and, accordingly, rotates with rotation of roller 280. Toothed wheel 300 preferably comprises teeth 310, wherein teeth 310 are preferably disposed symmetrically around toothed wheel 300, and wherein teeth 310 are preferably separated from one another via openings 330. Toothed wheel 300 is preferably disposed within gap 350 of optoelectronic coupler 320, as more fully described hereinbelow.

Roller 280 may optionally comprise a solid surface of resilient material in lieu of longitudinal ribs 290, wherein the resilient solid surface permits indentation of star points 430 therein as star points 430 are pressed into contact with roller 280 during rotation of star wheels 420.

Motor 170 preferably comprises any electrical motor as such is known in the art. Circuit board 260 preferably comprises electronic componentry 360 and optoelectronic coupler 320, wherein electrical signals from optoelectronic coupler 320 preferably travel to a computer (not shown) to time engagement and release of solenoids 460, thereby causing star points 430 to engage roller 280 without jamming. Motor 170 is preferably in rotational communication with angle drive 180, wherein angle drive 180 is preferably in rotational communication with shaft 400, optionally via gearing 190.

Figure 1C:
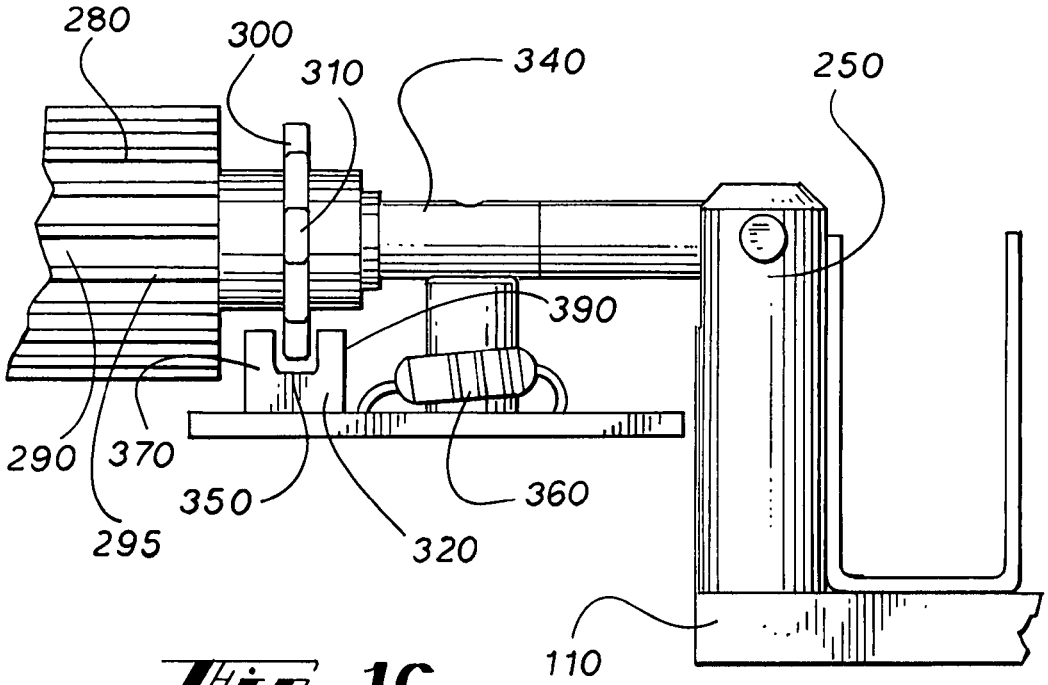
FIG. 1C is a side view of an optoelectronic chopper component comprising a 'U'-shaped channel and toothed wheel according to the preferred embodiment of FIG. 1A.
Figure 1D:
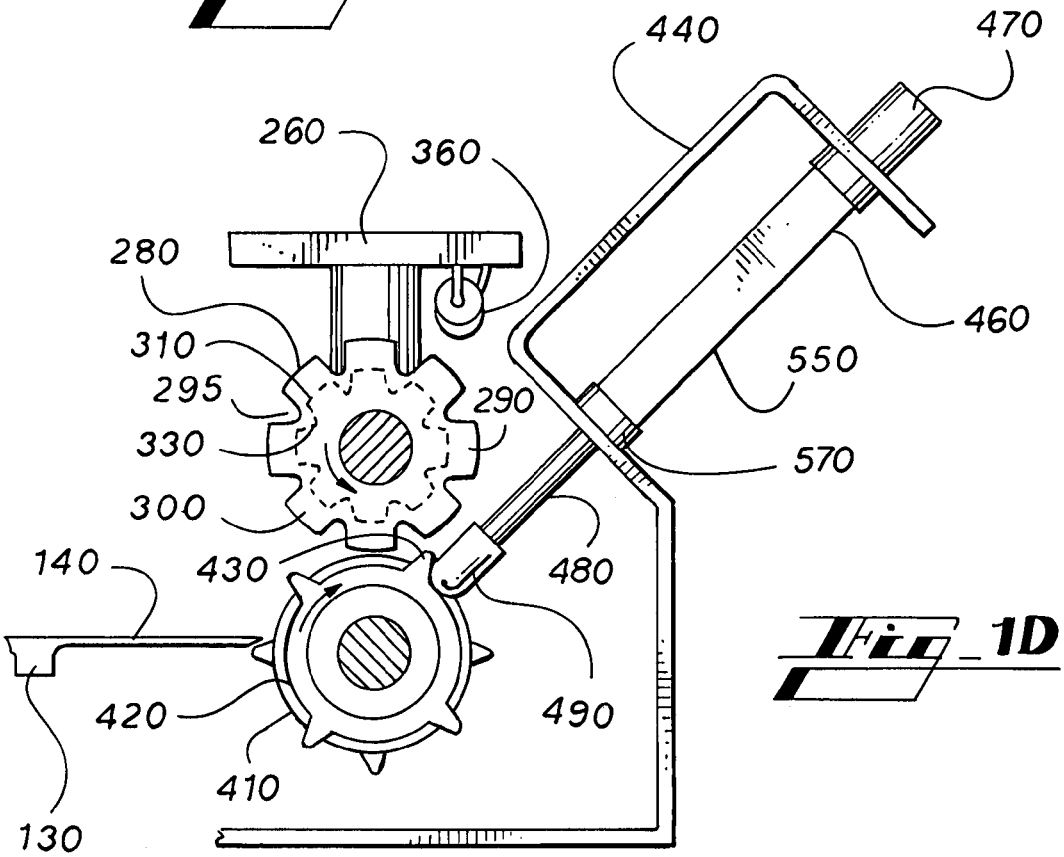
FIG. 1D is end detail view of mounted solenoids and an optoelectronic chopper component according to the preferred embodiment of the present invention.
Figure 2A:
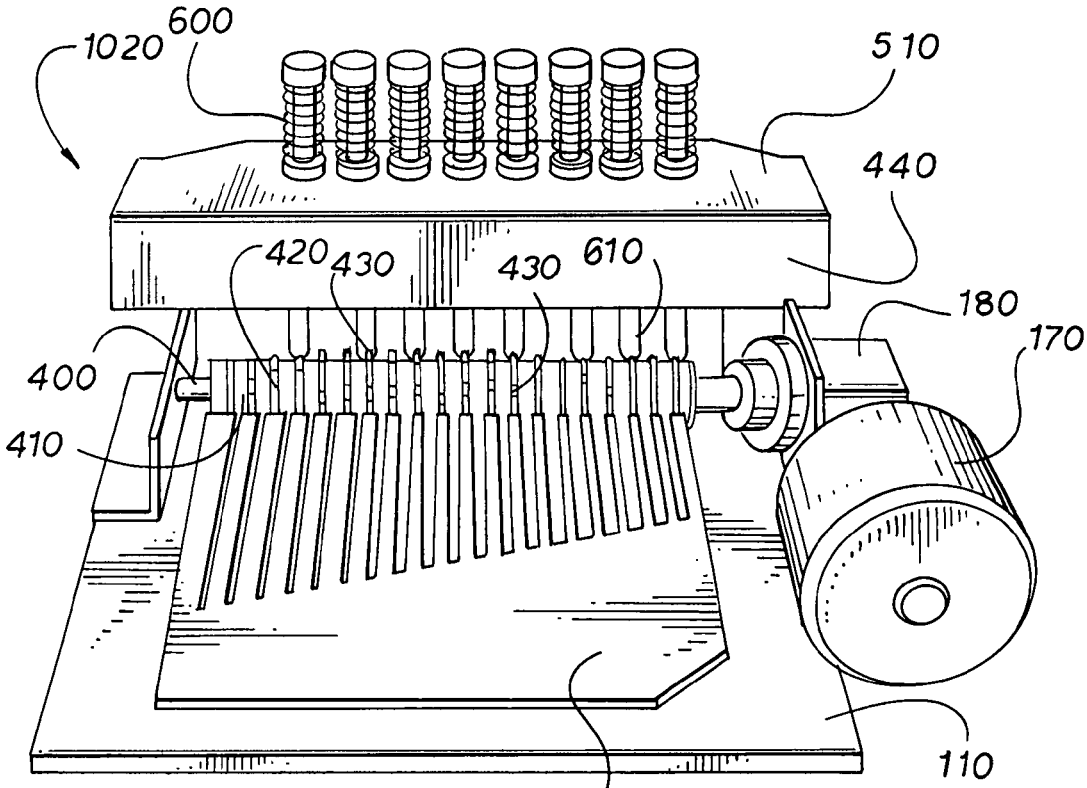
FIG. 2A is a front perspective view of a music box movement according to an alternate embodiment of the present invention.
Figure 2B:
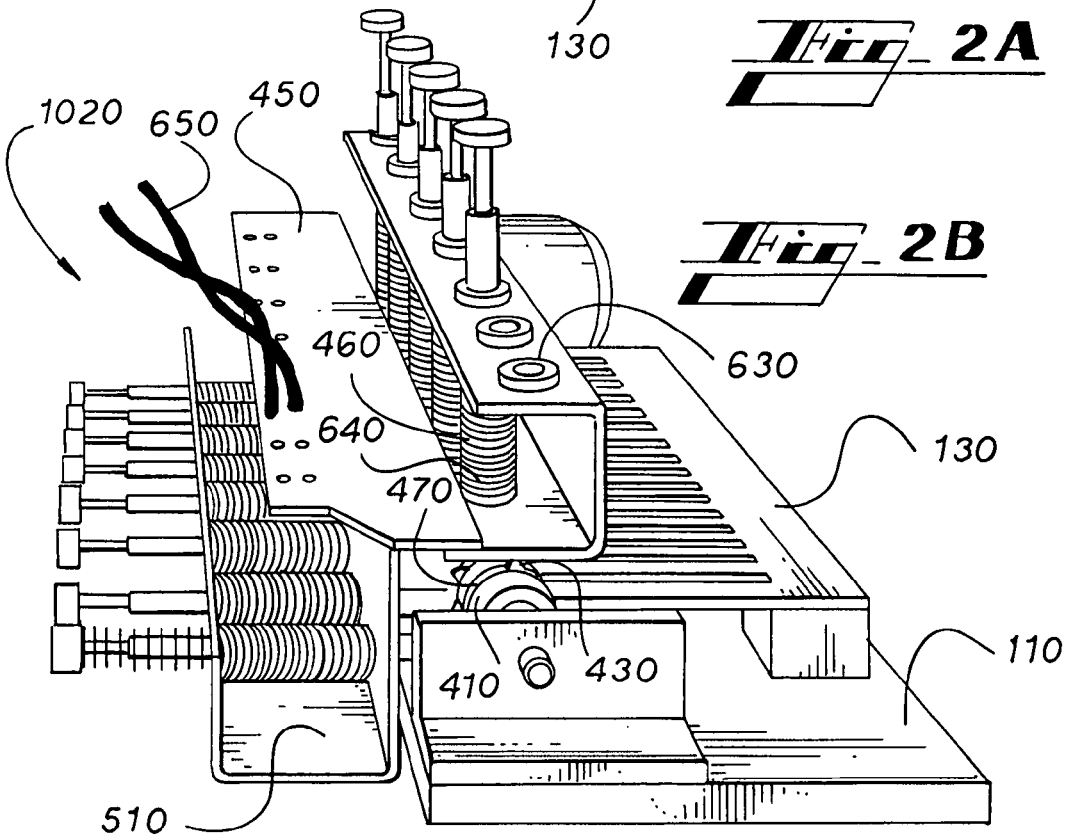
FIG. 2B is a side perspective view of the alternate embodiment depicted in FIG. 2A.

Referring now more particularly to FIG. 1D, solenoid frame 440 preferably comprises solenoids 460, wherein solenoids 460 preferably comprise sleeves 470, rods 480 having tips 490, coils 550 and wiring mandrels 570. Tips 490 are preferably fixedly attached to rods 480, wherein rods 480 preferably comprise any ferromagnetic material. Tips 490 preferably comprise any non-ferromagnetic material, such as, for exemplary purposes only, brass or rubber, in order that they are not magnetically attracted such as to star points 430. Rods 480 are preferably disposed within sleeves 470, wherein sleeves 470 preferably have coils 550 wound therearound and retained on sleeves 470 via wiring mandrels 570. Coils 550 are preferably connected to a power source (not shown), wherein passage of electrical power through coils 550 preferably causes operation of solenoids 460 by retraction of rods 480 within sleeves 470, and wherein rod 480 moves to center of coil 550 in ferromagnetic frame 440. Since rod 480 moves to center of coil 550 there is no metal-to-metal clicking sound normal to solenoid operation.

Solenoid frame 440 is preferably disposed at a forty-five degree angle to base 110, thereby preferably permitting installation of music box movement 100 in either a horizontal orientation or vertical orientation, wherein tips 490/rods 480 of solenoids 460 are preferably gravitationally attracted to move in the direction of star wheels 420.

In operation of music box movement 100, solenoids 460 are preferably selectively withdrawn within sleeves 470 via the application of electrical power through coils 550. Application of power to solenoid 460 with consequent withdrawal of rod 480 and tip 490, preferably permits corresponding star wheel 420 to rotate as shaft 400 preferably rotates via power applied to angle drive 180 from motor 170. However, star wheels 420 are in slidable rotation with shaft 400 and do not rotate with adequate force to ensure that star points 430 will pass tines 140. Accordingly, additional force to rotate star wheels 420 is required to cause plucking of tines 140. As one of star wheels 420 rotates, one of star points 430 on the periphery of star wheel 420 preferably enters groove 295 of roller 280, wherein roller 280 continues rotation of star wheel 420 with adequate force to ensure that an additional star point 430 on star wheel 420 passes in contact with its respective tine 140, thereby preferably causing tine 140 to emit its characteristic tone. As star wheel 420 and roller 280 continue to rotate after plucking tine 140, the first star point 430 exits groove 295. Star wheel 420 then continues its natural rotation caused by its disposition on rotating shaft 400 and frictional engagement with spacers 410. Removal of power to solenoid 460 preferably permits its corresponding rod 480 and tip 490 to fall under gravitational influence toward star wheel 420, wherein contact of tip 490 with star point 430 of star wheel 420 preferably impedes rotation of star wheel 420, thereby preferably preventing other star points 430 on individual star wheel 420 from plucking individual star wheel 420's respective tine 140.

Rotation of roller 280 in turn preferably causes rotation of toothed wheel 300, wherein teeth 310 preferably pass within gap 350 of optoelectronic coupler 320. Light from source 370 is preferably blocked by rotation of teeth 310 and does not reach receptor 390. As teeth 310 rotate, light from source 370 preferably passes through openings 330 and is preferably received by receptor 390, wherein a signal is subsequently preferably sent by optoelectronic coupler 320 to a computer (not shown) for timing of release of solenoids 460.

Referring now more specifically to FIGS. 2A-2F, illustrated therein is an alternate embodiment of device 100, wherein the alternate embodiment of FIGS. 2A-2F is substantially equivalent in form and function to that of the preferred embodiment detailed and illustrated in FIGS. 1A-1D except as hereinafter specifically referenced. Specifically, the embodiment of FIGS. 2A-2F comprises music box movement 1020, wherein music box movement 1020 comprises base 110, comb 130 having tines 140 thereon, motor 170, angle drive 180, shaft 400, and solenoid frame 440. Shaft 400 has spacers 410 and star wheels 420 disposed thereon, wherein star wheels 420 have star points 430 symmetrically disposed on the periphery thereof. Solenoid frame 440 comprises upper frame 510 and lower frame 520, wherein upper and lower frames 510, 520 are disposed perpendicular to one another. Upper frames 510, 520 comprise solenoid mounts 630, wherein solenoids 460 are disposed within solenoid mounts 630. Solenoids 460 comprise solenoid coils 640, tips 610 having grooves 620 thereon, lower shafts 690, main shafts 680, upper shafts 670 and caps 660, wherein tips 610 comprise, for exemplary purposes only, rubber, urethane or similar pliant material, or soft metals, such as brass.

Wiring board 450 receives wires 650, wherein wires 650 are in electrical communication with solenoid coils 640. Main shafts 680 comprises a ferromagnetic material, and are disposed within solenoid coils 640, wherein when solenoid coils 640 are energized via passage of the current through wires 650, main shafts 680 are selectively pushed or pulled toward or away from star wheels 420. Springs 600 provide return force when solenoids 460 are de-energized, wherein springs 600 may be selected to operate in compression or in tension. Lower shafts 690, upper shafts 670 and caps 660 comprise non-ferromagnetic material so that a magnetic field from coils 640 will only operate on main shaft 680.

Tines 140 may selectively comprise dampers 500 (best shown in FIGS. 2D and 2E) as are known in the art for suppressing secondary vibrations of tines 140.

In use, energizing a selected solenoid 460 pushes tip 610, wherein tip 610 contacts and pushes star point 430, thereby causing rotation of star wheel 420. Alternately, as tip 610 passes star wheel 420, groove 620 (best shown in FIG. 2D) in rubber tip 610 captures another of star wheel points 430, thereby continuing rotation of star wheel 420 as tip extends. Rotation of star wheel 420 causes star point 430 to pluck tine 140, wherein tine 140 subsequently emits its characteristic musical tone.

Figure 3A:
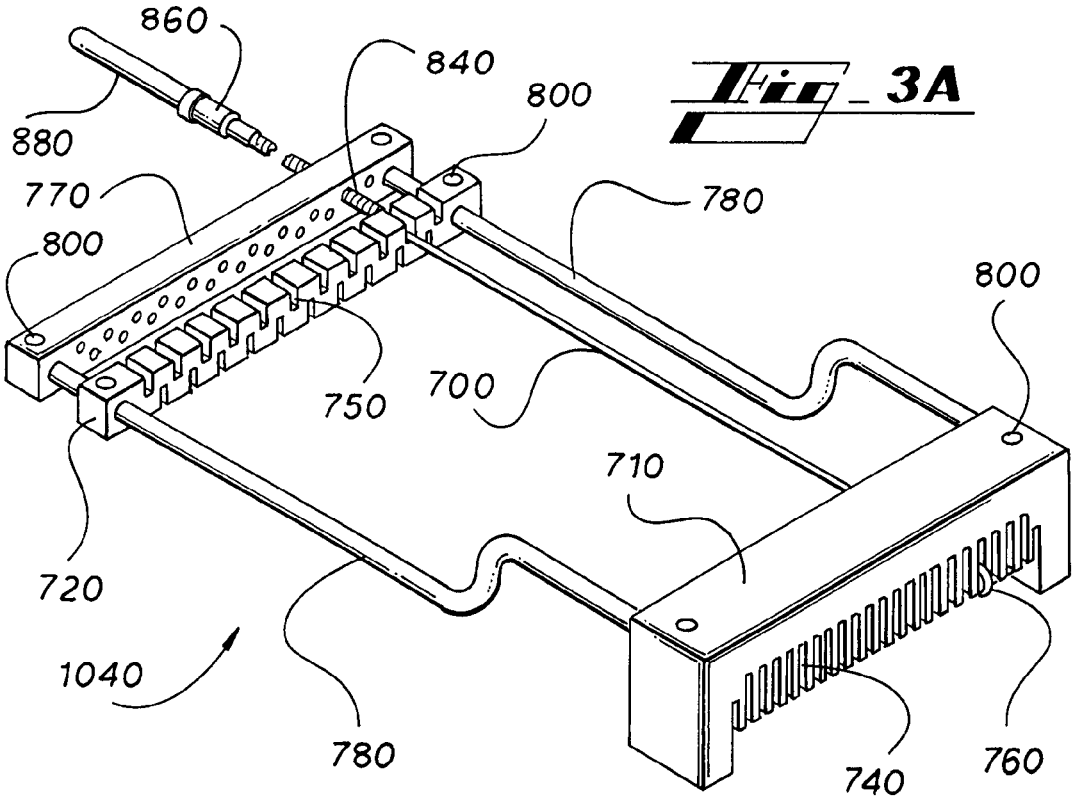
FIG. 3A is a perspective view of a retrofittable hook array according to an alternate embodiment of the present invention.
Figure 3B:
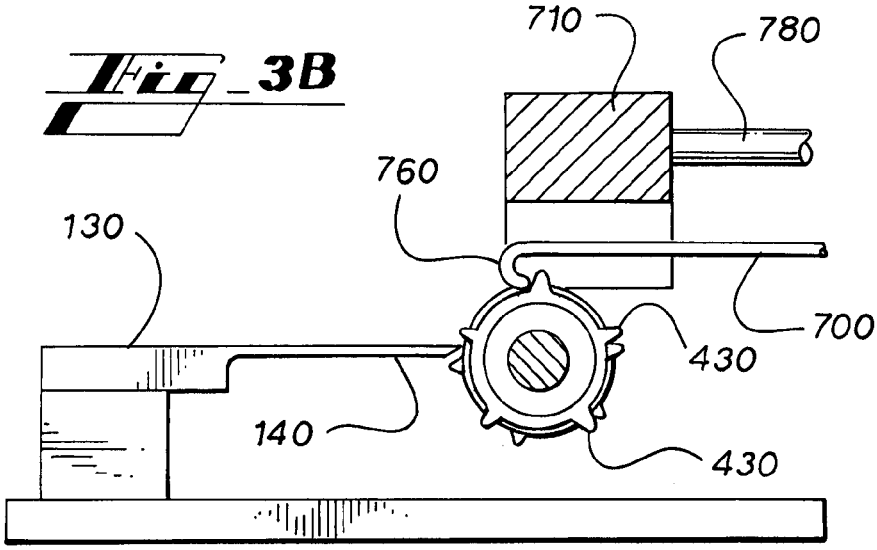
FIG. 3B is a side view of a hook and star wheel mechanism according to the alternate embodiment of FIG. 3A.

Referring now more specifically to FIGS. 3A-3B, illustrated therein is an alternate embodiment of device 100, wherein the alternate embodiment of FIGS. 3A-3B is substantially equivalent in form and function to that of the preferred embodiment detailed and illustrated in FIGS. 1A-1D except as hereinafter specifically referenced. Specifically, the embodiment of FIGS. 3A-3B comprises hook mechanism 1040, wherein hook mechanism 1040 comprises first wire manifold 710, second wire manifold 720, guide block 770, rails 780, and hook wires 700 having hook ends 760.

First manifold 710, second manifold 720 and guide block 770 are disposed on rails 780, wherein manifolds 710, 720 and guide block 770 are adjustably secured to rails 780 via fasteners 800. Hook ends 760 of hook wires 700 are disposed within first wire slots 740 of first manifold 710, wherein first manifold 710 provides limitation of moment of hook ends 760, restricting upward movement of same. Hook wires 700 are further disposed within second wire slots 750 of second manifold 720 wherein second wire slots 750 are disposed in staggered configuration to ease dimensional requirement and to facilitate operation, and wherein second manifold 720 provides limitation of movement of hook wires 700, selectively restricting either upward or downward movement of same. Guide block 770 secures wire guide sheath 840, wherein hook wires 700 are slightly disposed within wire guide sheath 840, wherein wire guide sheath 840 can be secured within any suitable fixed mount via retainer 860. Hook wires 700 are in communication with solenoid rod 880. Solenoid rod 880 is disposed within a solenoid coil (not shown), thereby permitting selective solenoid movement of hook wires 700 and hook ends 760.

In use, hook mechanism 1040 could be incorporated as part of a music box movement that includes star wheels 420 having star points 430 thereon, or alternately added to an existing star wheel operated music box apparatus after removal of the existing drive mechanism thereof. Rotation of star wheels 420 via pulling of hook ends 760 against star points 430, causes star wheels 420 to rotate, thereby plucking tines 140. When solenoid rods 880 are released, hook ends 760 pass over star wheels 420 preparatory to engaging subsequent star points 430. Further, additional star points 430 may be utilized about periphery of star wheel 420 to ensure disposition of star points 430 proximate tines 140 prior to pulling of star wheel 420 by hook ends 760.

Figures 1B, 4A:
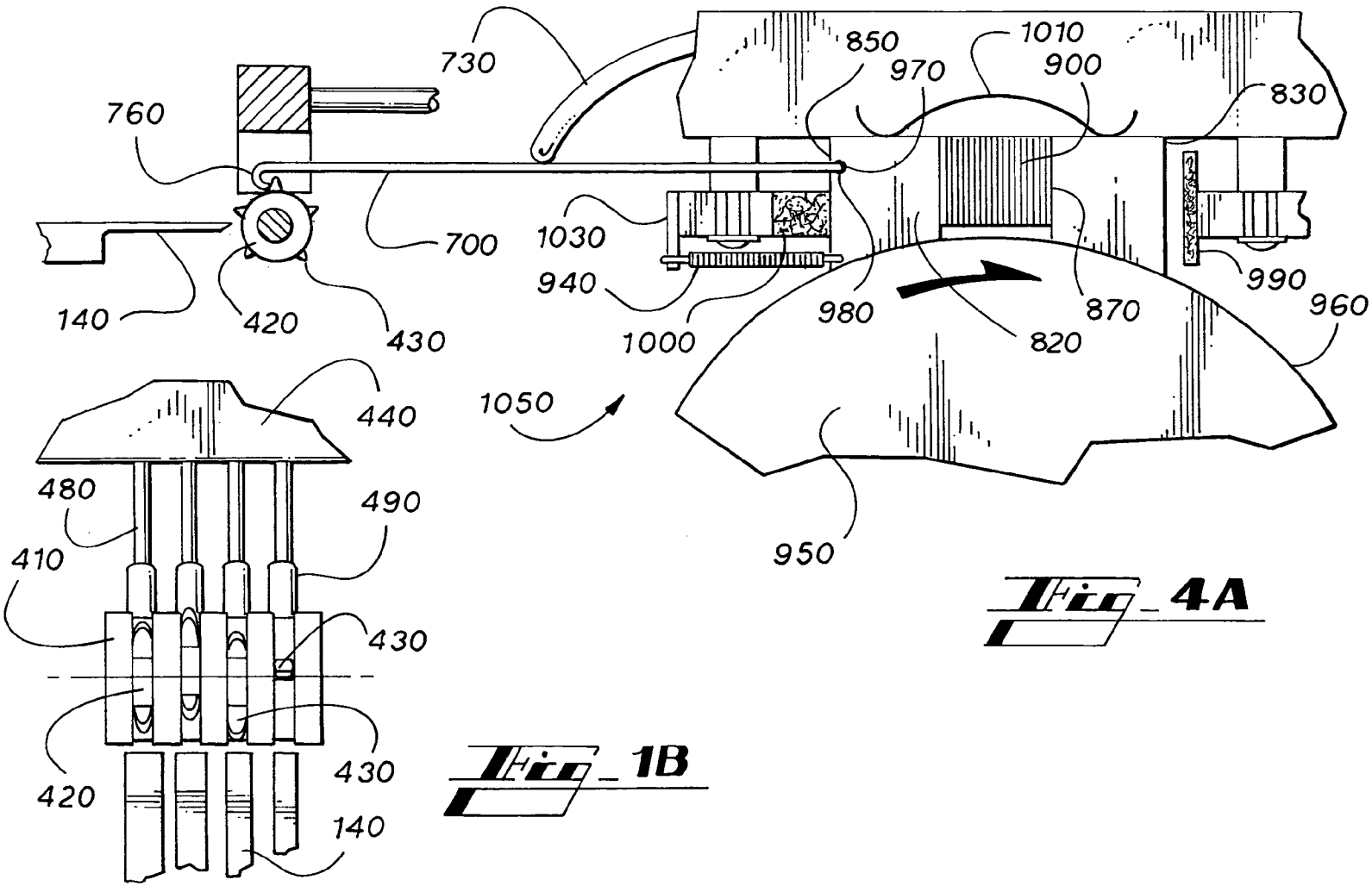
FIG. 1B is a detail top view of the solenoid/star wheel interface of the music box mechanism of FIG. 1A.
FIG. 4A is a side view of an electromagnetic clamping mechanism according to an alternate embodiment of the present invention.
Figure 4B:
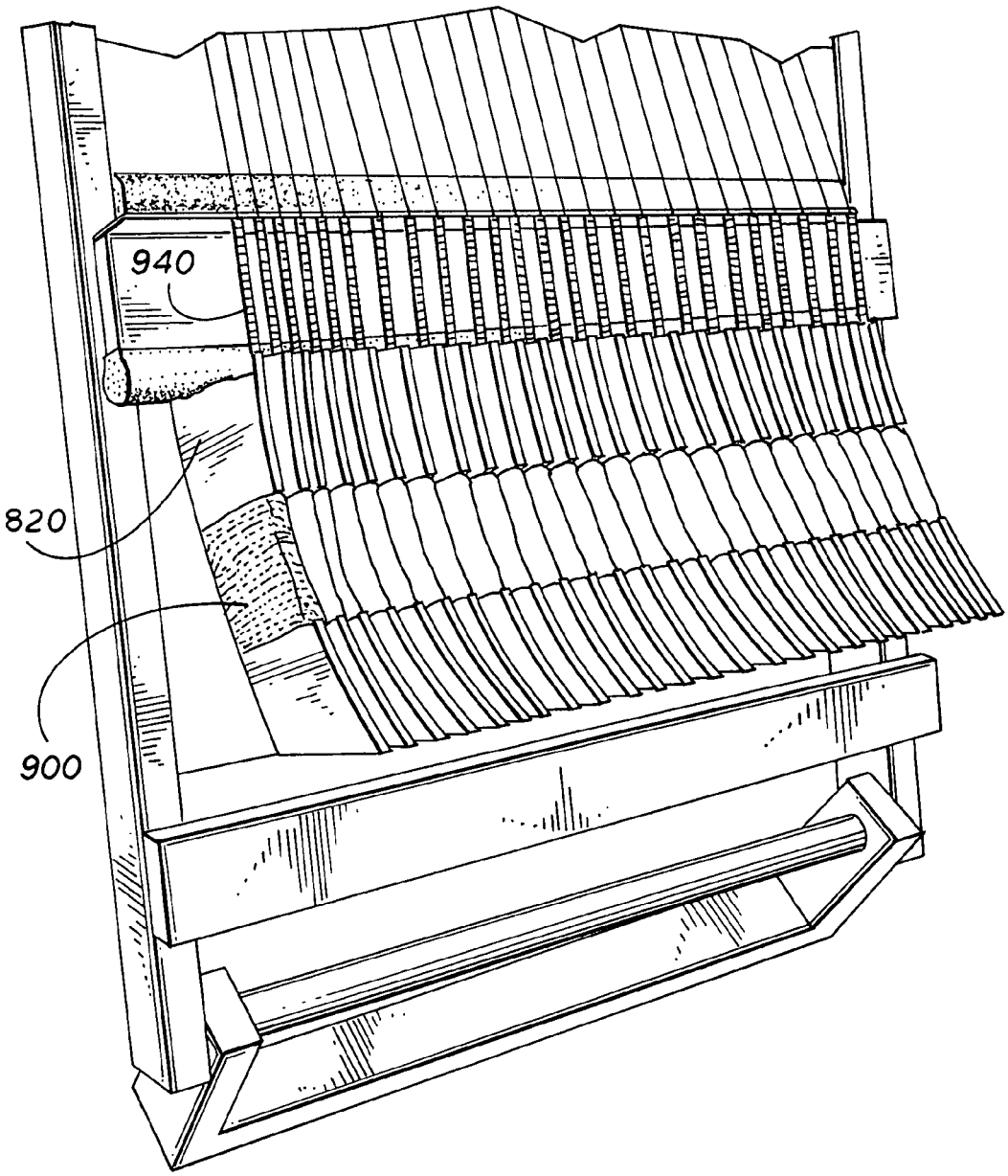
FIG. 4B depicts in perspective view a gang of electromagnet plates according to the alternate embodiment of FIG. 4A.

Referring now more specifically to FIGS. 4A-4B, illustrated therein is an alternate embodiment of device 100, wherein the alternate embodiment of FIGS. 4A-4B is substantially equivalent in form and function to that of the preferred embodiment detailed and illustrated in FIGS. 1A-1D except as hereinafter specifically referenced. Specifically, the embodiment of FIGS. 4A-4B comprises electromagnetic mechanism 1050, wherein electromagnetic mechanism 1050 comprises hook wires 700, plates 820 wound with coils 900, springs 1010 and drum 950, wherein springs 1010 retain plates 820 in downward disposition lightly towards surface 960 of drum 950. Plates 820 have first end 830, second end 850 and middle 870, wherein coils 900 are wound around middles 870. Plates 820 are formed of ferromagnetic material such that when coils 900 are energized, plates 820 are attracted toward surface 960 of drum 950. In an alternate embodiment, plates 820 could have a top radius concentric with the radius of drum 950.

Felt, or cork, 990 is disposed behind first end 830 of plates 820, wherein first end 830 will impact on felt 990 and be limited in further movement thereby. Similarly, felt 1000 is disposed in front of second end 850, limiting excessive travel of plates 820 when coils 900 are de-energized. Further, felts 990, 1000 serve to dampen sound of movement of plates 820, thereby imparting quiet operation to electromagnetic mechanism 1050.

Hook wires 700 are in pivotal communication with plates 820, wherein loops 970 of hook wires 700 are disposed within apertures 980 of plates 820. Return springs 940 are connected to frame 1030 and plates 820, wherein return springs 940 exert return force to plates 820, thereby returning plates 820 towards star wheels 420 when coils 900 are de-energized. Hook wires 700 are retained in position via tensioning member 730, wherein tensioning member 730 could selectively comprise a spring that pulls hook wires 700 downward, or a rigid arm that presses hook wires 700 downward. Hook wires 700 terminate in hook ends 760, wherein hook ends 760 removably engage star points 430 of star wheels 420.

In use, drum 950 rotates at a selected optimum constant speed and a selected coil 900 is energized, pulling its respective plate 820 away from star wheels 420. As plate 820 travels away from star wheels 420, it pulls hook wire 700 and consequently hook end 760, wherein hook end 760 pulls star point 430, thereby rotating star wheel 420. As star wheel 420 rotates, another of star points 430 thereon plucks tines 140. When coil 900 is de-energized, hook end 760 returns toward star wheel 420, and gathers next star point 430 preparatory to being later selected to perform another plucking operation.

It is envisioned in an alternate embodiment of the present invention that roller assembly 200 without shaft 400, spacers 410, star wheels 420 could be retrofitted to an existing music box movement having a shaft with star wheels thereon, thereby permitting computer control timing of operation of the existing music box movement mechanism.

In another alternate embodiment of the present invention, roller assembly 200 including shaft 400, spacers 410 and star wheels 420 could be retrofitted to an existing music box movement having a shaft with star wheels thereon, wherein roller assembly 200 rotates in its reverse direction, and wherein star wheels 420 contact and operate the star wheels of the existing music box movement.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A music box movement comprising:

a base frame, a musical comb, a shaft having at least one star wheel having star points disposed thereon, and a means for rotation of said shaft; and at least one electromagnetic mechanism, wherein said at least one electromagnetic mechanism engages said at least one star wheel to restrain movement thereof, and wherein said at least one star wheel rotates only when said at least one electromagnetic mechanism is removed from contact with said at least one star wheel.

2. The music box movement of claim 1, wherein said electromagnetic mechanism comprises at least one solenoid comprising a solenoid rod, wherein said at least one star wheel is biased for rotation by light frictional engagement of said at least one star wheel with spacers secured to said shaft, and wherein said star wheel is prevented from rotational movement via engagement of said solenoid rod with said star points.

3. The music box movement of claim 1, wherein said at least one electromagnetic mechanism is disposed within a solenoid frame secured to said base frame, and wherein said at least one electromagnetic mechanism comprises a solenoid, and wherein said solenoid comprises a rod, and wherein said solenoid frame is disposed to permit said rod to move in the direction of said at least one star wheel, and wherein said at least one electromagnetic mechanism is in linear communication with said at least one star wheel.

4. The music box movement of claim 2, wherein said at least one solenoid rod is gravitationally attracted to a position proximate said at least one star wheel when said at least one solenoid is disengaged.

5. The music box movement of claim 1, further comprising an optoelectronic chopper, wherein said optoelectronic chopper is in electrical communication with said at least one electromagnetic mechanism, and wherein said at least one electromagnetic mechanism engages said star wheel when signals from said optoelectronic chopper select engagement of said at least one electromagnetic mechanism.

6. The music box movement of claim 1, further comprising a star wheel shaft driven by a motor, wherein said at least one star wheel is in slidable rotational engagement with said star wheel shaft, and wherein said at least one electromagnetic mechanism engages said at least one star wheel, and wherein withdrawal of said at least one electromagnetic mechanism from engagement with said at least one star wheel permits rotation of said at least one star wheel by said star wheel shaft.

7. The music box movement of claim 1, wherein said at least one electromagnetic mechanism comprises a coil-wrapped plate and a rotating drum.

8. The music box movement of claim 1, further comprising a roller, wherein said at least one star wheel is driven by rotation of said roller, and wherein said roller is in contact with one of said star points, and wherein rotation of said at least one star wheel is permitted by energizing of said at least one electromagnetic mechanism.

9. The music box movement of claim 8, wherein said roller comprises a surface selected from the group consisting of smooth surfaces and ribbed surfaces.

10. The music box movement of claim 1, wherein said at least one electromagnetic mechanism is controlled via a computer.

11. The music box movement of claim 1, wherein said electromagnetic mechanism comprises at least one solenoid comprising a solenoid rod, and wherein said at least one star wheel is biased for rotation by light frictional engagement with said shaft, and wherein said star wheel is prevented from rotational movement via engagement of said solenoid rod with said at least one star wheel.

12. A method of operating a music box movement comprising at least one star wheel, said method comprising the steps of:

biasing said at least one star wheel to rotate, when permitted;

permitting rotation of said au least one star wheel by removal of contact of a solenoid rod with said at least one star wheel; and rotating star points of said at least one star wheel in a path to actuate a tone producing element in the music box movement.

13. The method of claim 12, further comprising the step of:

preventing movement of said at least one star wheel, thereby stopping said star points from actuating said tone-producing element of the music box movement.

14. The method of claim 13, wherein said music box movement further comprises at least one solenoid, and wherein said step of preventing further comprises the step of:

de-energizing said solenoid by removal of electrical current therefrom.

15. The method of claim 12, wherein said music box movement further comprises at least one solenoid, and wherein said step of permitting further comprises the step of:

energizing said solenoid by application of electrical current thereto.

16. A music box movement comprising:

a frame, a musical comb disposed within said frame, at least one star wheel disposed on a rotational shaft within said frame, wherein said at least one star wheel is biased to rotate by rotation of said shaft, when permitted;

and at least one solenoid, wherein rotation of said at least one star wheel is permitted when said at least one solenoid is energized, and wherein when energized said at least one solenoid withdraws from contact with said at least one star wheel to permit rotation thereof, and wherein said at least one star wheel contacts a sound producing element to produce sound therefrom, and wherein rotation of said at least one star wheel is prevented when said at least one solenoid is de-energized.

17. The music box movement of claim 16, further comprising a ribbed roller disposed on said frame in contact with said at least one star wheel, wherein said ribbed roller engages said at least one star wheel.

18. The music box movement of claim 17, further comprising an optoelectronic chopper in electrical communication with said at least one solenoid, wherein said optoelectronic chopper controls timing of engagement of said at least one solenoid.

* * * * *